US005140901A

United States Patent [19]

John

[11] Patent Number: 5,140,901

[45] Date of Patent: Aug. 25, 1992

[54] PRINTING MACHINE WITH CHAMBERED DOCTOR BLADE UNIT

[75] Inventor: Thomas John, Augsburg, Fed. Rep. of Germany

[73] Assignee: Man Roland Druckmaschinen AG, Offenbach am Main, Fed. Rep. of Germany

[21] Appl. No.: 667,505

[22] Filed: Mar. 11, 1991

[30] Foreign Application Priority Data

Apr. 20, 1990 [DE] Fed. Rep. of Germany ..... 4012618

[51] Int. Cl.[5] ..... B41F 31/06

[52] U.S. Cl. ..... 101/366; 101/350; 101/351

[58] Field of Search ..... 101/366, 352, 330, 331, 101/340, 350, 351; 285/92, 332, 349, 174, 238

[56] References Cited

U.S. PATENT DOCUMENTS

| | | | |
|---|---|---|---|
| 572,911 | 12/1896 | Schmidt | 285/332 |
| 612,455 | 10/1898 | Gore | 285/349 X |
| 2,271,657 | 2/1942 | Miller | 285/238 X |
| 2,290,239 | 7/1942 | Hopson | 285/238 X |
| 2,624,598 | 1/1953 | Quinlan | 285/9.2 |
| 2,701,147 | 2/1955 | Summerville | 285/174 |
| 3,400,658 | 9/1968 | Gagliardi | 101/366 |
| 3,739,721 | 6/1973 | Miarkowaki | 101/366 |
| 4,733,890 | 3/1988 | Vyse | 285/174 |
| 4,821,672 | 4/1989 | Bruno | 101/169 X |
| 4,998,474 | 3/1991 | Hauer | 101/366 |

FOREIGN PATENT DOCUMENTS

| | | | |
|---|---|---|---|
| 294022 | 12/1988 | European Pat. Off. | 101/366 |
| 1611285 | 12/1970 | Fed. Rep. of Germany . | |
| 2811276 | 9/1979 | Fed. Rep. of Germany | 101/350 |
| 3326228 | 3/1984 | Fed. Rep. of Germany . | |
| 891219405 | 1/1990 | Fed. Rep. of Germany . | |
| 3832183 | 2/1990 | Fed. Rep. of Germany . | |
| 3832148 | 4/1990 | Fed. Rep. of Germany . | |
| 26003 | 11/1909 | United Kingdom | 285/9.2 |
| 611168 | 10/1948 | United Kingdom | 285/9.2 |

*Primary Examiner*—Edgar S. Burr
*Assistant Examiner*—Eric P. Raciti
*Attorney, Agent, or Firm*—Frishauf, Holtz, Goodman & Woodward

[57] ABSTRACT

To eliminate the necessity of a hose connection between a chambered doctor blade unit (1) and an ink supply unit (14), the ink supply unit and the chambered doctor blade unit are, each, formed with an ink supply duct and an ink reception duct, respectively, which, when the chambered doctor blade unit is in operative position engaged against an ink roller (3), fits against the ink supply duct; upon rotation or sliding-away of the chambered doctor blade unit (1), the fluid communication between said ducts is released, thereby permitting ready removal of the chambered doctor blade unit, for example for cleaning or servicing.

5 Claims, 4 Drawing Sheets

FIG. 5
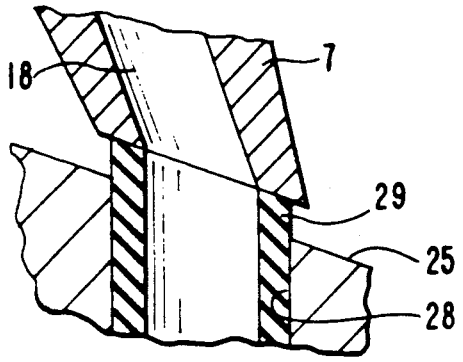
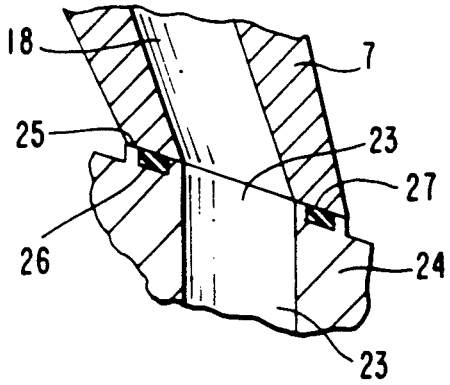
FIG. 4
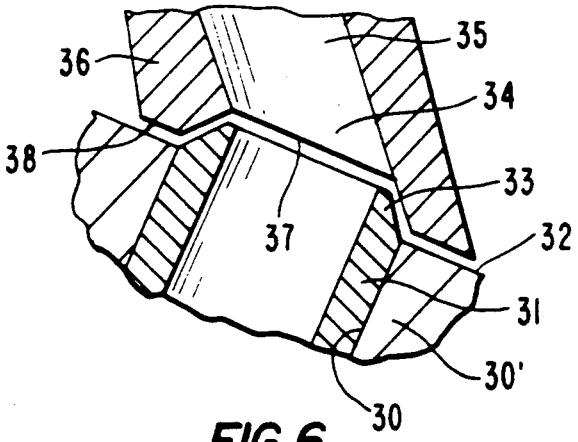
FIG. 6

PRINTING MACHINE WITH CHAMBERED DOCTOR BLADE UNIT

Reference to related application, assigned to the assignee of the present invention, the disclosure of which is hereby incorporated by reference:

U.S. Ser. No. 07/403,754, filed Sep. 6, 1989, John et al, now U.S. Pat. No. 4,998,475, Nov. 26, 1991, to which German DE-PS 38 32 183 Cl in part corresponds.

FIELD OF THE INVENTION

The present invention relates to printing machines, and more particularly to printing machine inkers having a chambered doctor blade unit which receives ink from an inker unit, and in which the chambered doctor blade unit can be moved, selectively, between an engaged position in which it is engaged against a printing machine roller, such as an anilox roller, and a removed position, in which the chambered doctor blade unit is removed or released from engagement with the roller, so that it can be lifted off, and entirely removed from the printing machine, for example for cleaning or servicing.

BACKGROUND

Portions of inkers for printing machines often must be cleaned or removed from the printing machine, for example to use the inker with ink of a different color, replacement of doctor blades, servicing or the like. Ink must be supplied to the chambered doctor blade unit and, typically, an ink trough and a pump are connected by a hose or by tubing to the chambered doctor blade unit. The referenced U.S. Pat. No. 4,998,475, John et al, assigned to the assignee of the present application and the disclosure of which is hereby incorporated by reference, describes a chambered doctor blade unit in which the unit itself is connected via a hose or tube with a pump and ink supply arrangement. The hose is coupled to the pump by a releasable hose coupling or connection union. It has been found that it is time-consuming, and sometimes awkward, to disconnect the hose and/or its coupling to clean the chambered doctor blade unit, for example if change in the color of ink is desired. Frequently, there is only little space in which to work.

THE INVENTION

It is an object to provide a chambered doctor blade inker which readily permits separating the chambered doctor blade unit from the ink supply therefor.

Briefly, the chambered doctor blade unit is formed with an ink reception duct, and the ink supply unit, typically an ink trough and a pump, is formed with an ink supply duct, the ink reception duct and the ink supply duct being so located on the machine that they either match against each other, with the openings therein fitting against each other or, preferably, fit into each other, for example with a conical engagement fit. A selective engagement or movement control is provided which so places the chambered doctor blade unit that, when it is in operative condition against an ink supply roller, such as an anilox roller, the reception opening in the ink reception duct is in coupled fluid communication with the ink supply opening of the ink supply duct; yet, since no hose couplings are provided, removal of the chambered doctor blade unit from the machine is simple and can be carried out rapidly.

DRAWINGS

FIG. 1 is a highly schematic side view of a chambered doctor blade unit engaged against an anilox roller of a printing machine;

FIG. 2 shows the system of FIG. 1, with the chambered doctor blade unit swung away from the anilox roller; and FIG. 3 shows the system with the chambered doctor blade unit removed and separated to permit cleaning or servicing, for example; and FIGS. 4, 5 and 6 illustrate various embodiments of coupling arrangements to couple the ink supply duct and the ink reception duct to each other when the system is in the position of FIG. 1.

DETAILED DESCRIPTION

Figure 1:
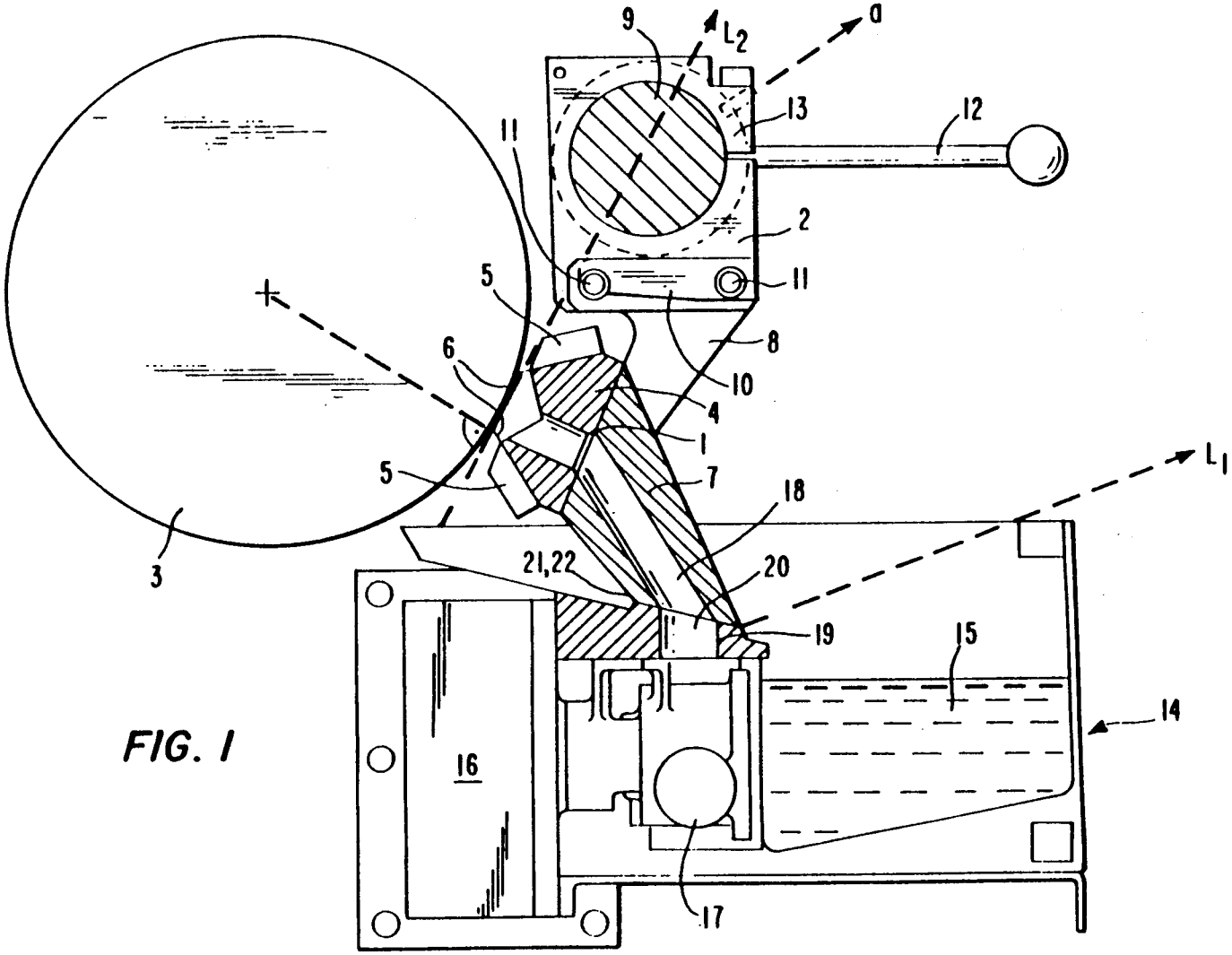

Referring first to FIG. 1:

A chambered doctor blade unit 1 can be engaged by a positioning system 2 against an anilox roller 3. The chambered doctor blade unit 1 has an ink chamber structure 4, and two doctor blades 6 which are coupled to the ink chamber unit 4 by clamping rails or strips 5.

The unit 1 is coupled to a holder 8 which can be secured on the positioning system 2. The positioning system 2 includes a cross rail 9, secured between two side walls of a printing machine. The cross rail is rotatable about is axis. For each holder 8, a holder attachment 10 is provided, secured to the cross rail 9. The holder 8 of the unit 1 can be hooked by two bolts 11, the axes of which extend parallel to the axis of the anilox roller 3 on the holder attachment 10. A manual lever 12, coupled to an eccenter 13, is located rotable about the rail 9. The eccenter 13, upon movement thereof, can press the bolts 11 of the holder 8 against the attachment 10.

An ink supply system 14 is located beneath the chambered doctor blade 1. The ink supply system 14 includes an ink trough 15 in which the ink to be used for printing is retained, and a pump 17, coupled to a suitable drive 16.

In accordance with a feature of the invention, an ink reception duct unit or element 7 is secured to the chambered doctor blade unit 1; an ink supply duct unit or element 19 has an externally open supply exit opening 20. The ink reception duct unit 7 with its reception opening 18, and the ink supply duct 19 with its supply opening 20 are so positioned with respect to each other, when the chambered doctor blade unit is in the engaged position as shown in FIG. 1, that the respective supply and reception openings match, as seen in FIG. 1.

FIG. 1 illustrates the arrangement of the inker in operating position, in which the chambered doctor blade 1 is in engagement against the anilox roller 3, and the ink reception duct unit 7 is positioned on the ink supply duct unit 19, to form a continuous communication. The lower side of the ink reception duct unit 7 and the upper side of the ink supply duct unit 19 are, each, formed with flat engagement surfaces 21, 22 which, when the unit 1 is in the position shown in FIG. 1, are parallel to each other and in surface engagement with each other, that is, are fitted together.

If it is desired to exchange unit 1, for example to change to ink of another color, to clean the unit, or for servicing, the rail 9 is rotated about its axis.

Figure 2:
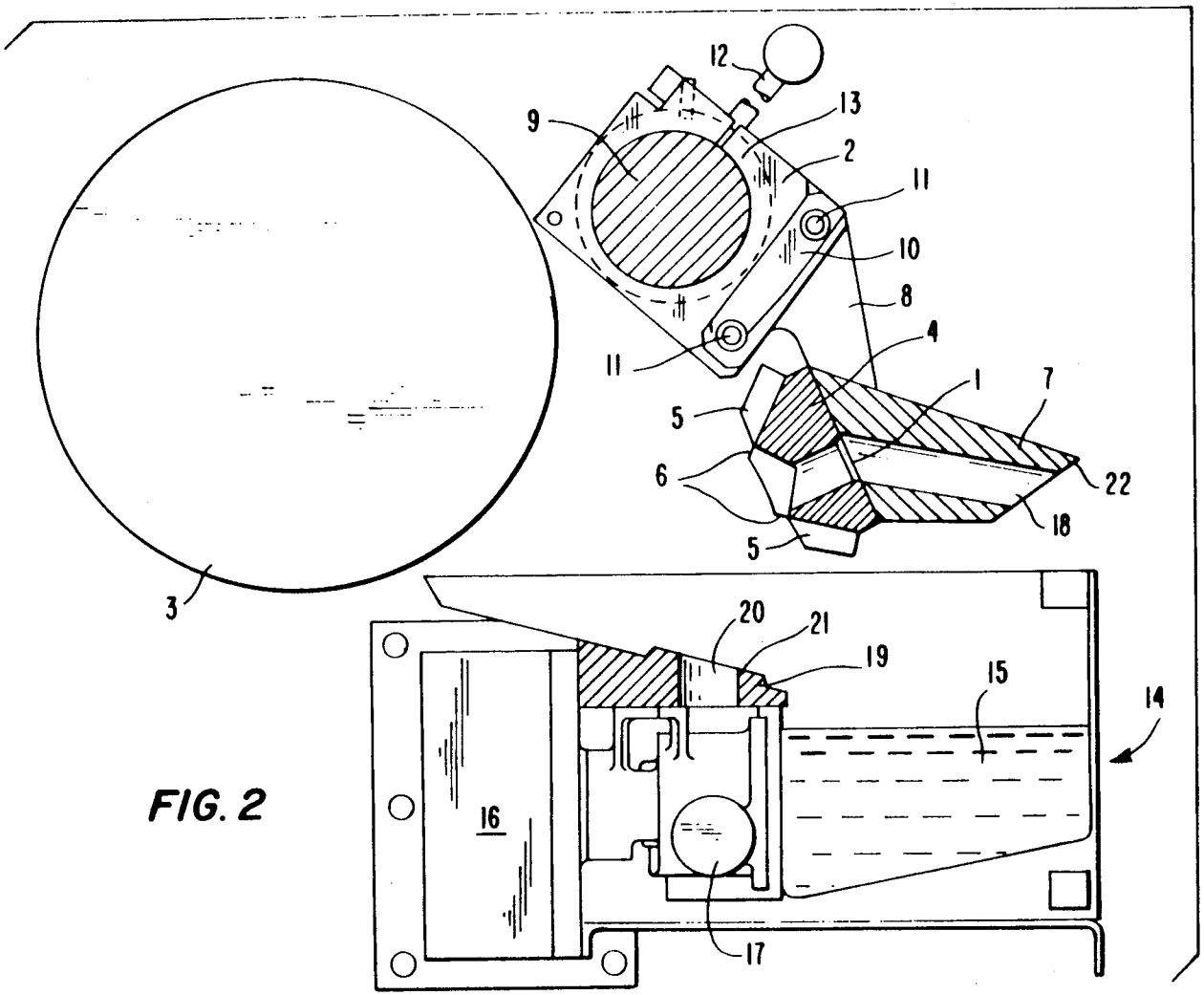

Referring now to FIG. 2:

Rotating the rail 9 removes the unit 1 from the anilox roller 3 and, at the same time, the ink reception duct unit 7 from the ink supply duct unit 19 of the ink supply system 14. The pivot path of the rail 9 is so dimensioned that the ink reception duct unit 7, in the operating position (FIG. 1), is in engagement with the ink supply duct unit 19 so that the reception opening 18 and the supply opening 20 are in alignment; however, when removed as seen in FIG. 2, the supply opening 20 is uncovered, and the reception opening 18, likewise, is accessible.

In the removal position, see FIG. 2, the holder 8 can be released from the unit 2 by rotating the eccenter 13, upon movement of the lever 12. The entire unit 1 can then be removed, for cleaning or servicing, as seen for example in FIG. 3.

Figure 3:
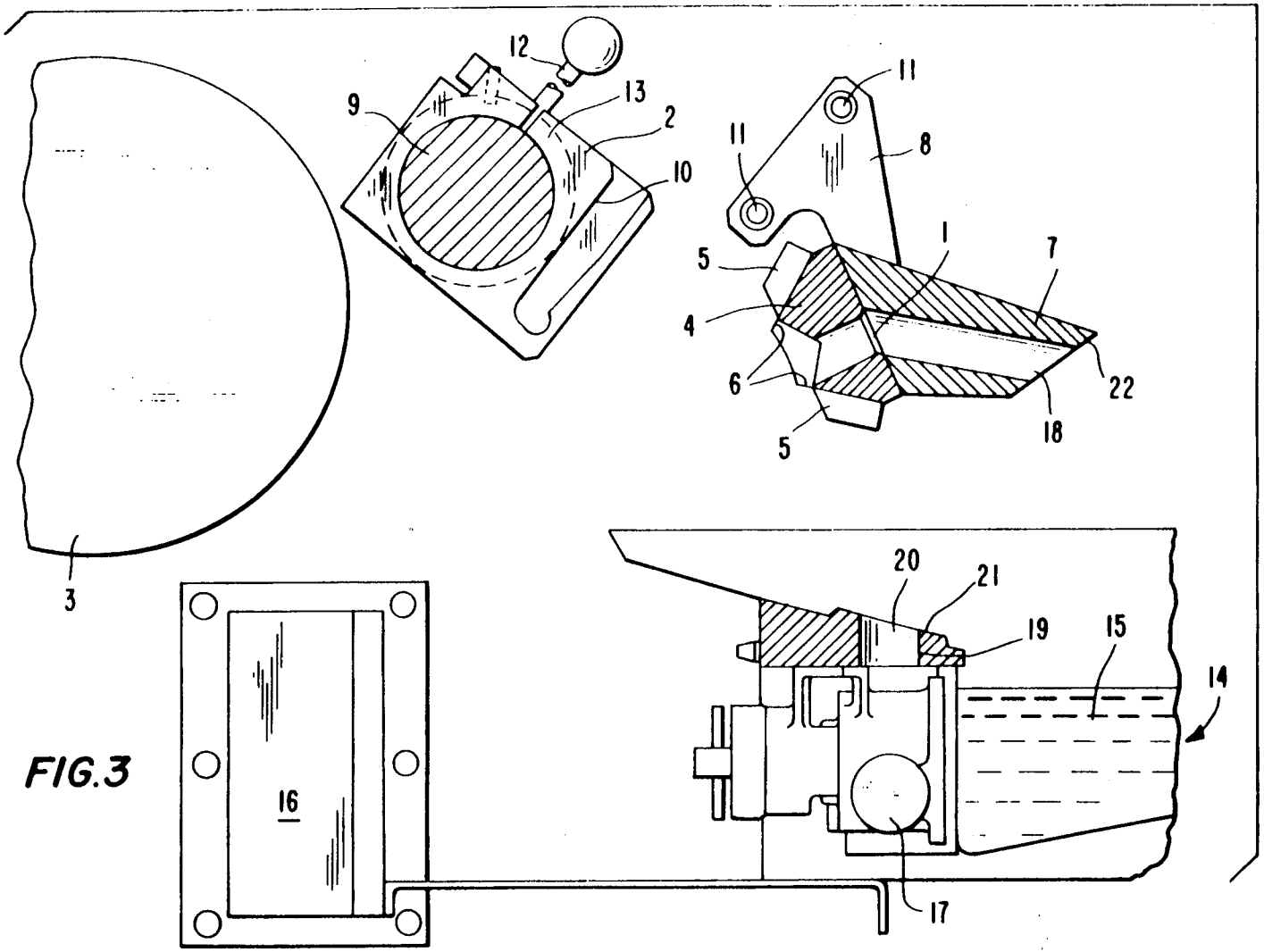

Preferably, the unit 14 can also be removed, as seen at the bottom of FIG. 3, by outward sliding movement; the pump 17 and the drive unit 16 can be coupled by a releasable coupling, for example a positive engagement coupling, as shown schematically in FIG. 3.

FIG. 4: A groove 26 is placed in the engagement surface 25 of the ink supply duct 24, surrounding the supply opening 23. A sealing ring 27 is fitted in the groove 26. The ink supply duct 7 engages against the sealing ring 27. This improves the sealing of the supply openings and the reception openings with respect to each other.

FIG. 5 illustrates another embodiment, in which the ink supply system 14 has an elastic tubular element 29, for example of plastic material or the like, inserted in the ink supply duct. The ink reception duct 7, when in operating position, engages against the elastic ink supply duct insert 29, which is fitted in a bore 28 of the ink supply unit 14. As an alternative, the ink supply duct 7, or both the ducts 7, 28, may have elastic tubular inserts located therein, for mutual engagement against each other. Slightly yielding materials improve the sealing effect of the reception opening and the supply opening with respect to each other, and permit compensation for slight tolerances in the operating path of the chambered doctor blade unit 1, when it is moved between engaged and removed or released position.

FIG. 6 illustrates yet another embodiment in which the ink supply duct 30 of the ink supply system 14 has a tubular element or pipe 31 fitted in the supply duct wall 30' which is formed with an essentially conical end portion; the ink reception duct 35 has a wall element 36 which, adjacent the ink reception opening 34, is formed with an essentially conical recess 37. In operating position, the conical recess 37 fits over the conical end piece 33 of the tubular element or pipe 31.

The arrangement in accordance with FIG. 6 has the advantage that, effectively, a labyrinth seal between the supply duct 30 and the reception duct opening 34 is obtained. A gap 38 can be left between the structural element 30' and the element 36. This gap 30 can be so small that no ink can escape, yet can compensate for inaccuracies when fitting the supply duct element 30' to the reception duct wall element 36. The gap is shown in FIG. 6 greatly enlarged for better visibility in the drawing.

In the embodiment according to FIGS. 1-3, engagement or removal of the chambered doctor blade unit with respect to the anilox roller 3 is obtained by rotation of the rail or cross element 9 about its axis. Other arrangements to remove the chambered doctor blade may be used, for example a sliding arrangement, in which the chambered doctor blade unit 1 is moved in a linear path. For example, rather than pivoting the rail 9, a translatory movement of the rail in the direction of the arrow a (FIG. 1) will remove the chambered doctor blade unit 1 and the ink reception duct 7 from engagement with the anilox roller 3 and the ink supply duct 19, respectively. The direction of linear movement, that is, the direction of the arrow a, must be between the directions of the lines $L_1$ and $L_2$. If the direction of the arrow a is more shallow than the line $L_1$, the ink reception duct 7 would catch on the ink supply system 14; it it is steeper than the line $L_2$, it is not possible to remove the chambered doctor blade unit 1 from the anilox roller 3. Basically, the line $L_1$ is a direct connection of the end of the ink supply duct unit 19 with the corner of trough 15 and the line $L_2$ is tangent to the roller 3 at the lower doctor blade 6 (see FIG. 1).

Various changes and modifications may be made, and any features described herein may be used with any of the others, within the scope of the inventive concept. For example, it is readily possible to include sealing elements in the conical connection of FIG. 6, such as O-rings and the like, retained on one of the ducts, for example by an adhesive, or within a suitable groove.

I claim:

1. Easily removable chambered doctor blade unit and ink supply combination for supply of printing ink to an ink roller (3), especially an anilox roller, having a chambered doctor blade unit (1, 4–7);

means (2, 8–13) for supporting the chambered doctor blade unit; and an ink supply system (14) including an ink trough (15) and an ink supply pump (17) having a pump outlet, to pump ink from the ink trough to the outlet, and comprising, in accordance with the invention, means forming an ink reception duct (7, 35) coupled to the chambered doctor blade unit, in ink communication therewith and having an externally open ink reception opening (18, 34);

means defining an ink supply duct (19, 24, 29, 30') coupled to the ink supply system (14) and having an externally open ink supply opening (20, 23); and wherein said supporting means (2, 8–13) movably supports said chambered doctor blade unit (1, 4–7), selectively, in a first position in engagement with the ink roller (3), or, in a second position, removed from engagement with the ink roller such that, when the chambered doctor blade unit is in engagement with the ink supply roller (3), the ink reception opening (18, 34) of the ink reception duct (7, 35) is located in alignment with the ink supply opening (20, 23) of the ink supply duct (19, 24, 29, 30') to form a continuous patch for supply of ink to the chambered doctor blade unit from the ink trough, and when the removable doctor blade unit is removed from engagement with the ink roller, the ink reception opening and the ink supply opening are separated from each other.

2. The combination of claim 1, wherein said ink reception duct (7) and said ink supply duct (19) each are formed with flat engagement surfaces (21, 22) fitting and matching against each other when said chambered doctor blade unit (1) is in position for engagement with said ink roller (3).

3. The combination of claim 1, wherein at least one of the ducts (7, 29) includes elastic material.

4. The combination of claim 1, wherein said ink reception duct and said ink supply duct each terminate in essentially flat, matching surfaces;

and a sealing ring (27) is embedded in one of said ducts, to fit against the flat surface of the other one of the ducts.

5. The combination of claim 1, wherein one of said ducts terminates in an essential conical end, and the other of said ducts is formed with an essentially conical recess, said conical end and recess fitting into each other to form an interengaging fluid communication coupling.

* * * * *